US005406806A

United States Patent [19]

Ricketts et al.

[11] Patent Number: 5,406,806

[45] Date of Patent: Apr. 18, 1995

[54] AUTOMATIC CHARGE REFRIGERANT TRANSFER SYSTEM

[75] Inventors: William H. Ricketts; Francis C. Flusche, both of Muskogee, Okla.

[73] Assignee: RSB Engineers/Planners, Inc., Muskogee, Okla.

[21] Appl. No.: 134,045

[22] Filed: Oct. 12, 1993

[51] Int. Cl.[6] ..... F25B 45/00

[52] U.S. Cl. ..... 62/149; 62/292; 62/475

[58] Field of Search ..... 62/292, 149, 77

[56] References Cited

U.S. PATENT DOCUMENTS 5,214,931 6/1993 Paige ..... 62/292

5,230,224 7/1993 Ricketts ..... 62/292

*Primary Examiner*—John M. Sollecito

*Attorney, Agent, or Firm*—Frank J. Catalano; Scott R. Zingerman

[57] ABSTRACT

An automatic charge or recharge refrigerant transfer system, increases the percentage of refrigerant transferred from a container to the air conditioning unit to be charged. The suction line of the compressor of the air conditioning unit is connected to the discharge of the transfer unit and the discharge of the recovery system is connected to the intake of the transfer unit. The intake of the recovery system is connected to the refrigerant source. The transfer system has an automatic flow path, a manual flow path and a return flow path. The automatic flow path automatically controls the flow of refrigerant from the source through the recovery system to the air conditioning unit at a predetermined maximum pressure level. The parallel manual flow path permits use of a hand valve to control the flow of refrigerant from the source through the recovery system to the air conditioning unit. Finally, the return flow path from the transfer system to a recovery container allows release of refrigerant from the air conditioning unit if the unit is overcharged.

10 Claims, 2 Drawing Sheets

AUTOMATIC CHARGE REFRIGERANT TRANSFER SYSTEM

BACKGROUND OF THE INVENTION

This invention relates generally to air conditioning systems and more particularly concerns systems for transfer of refrigerant from a source to a receiving unit.

In our U.S. Pat. No. 5,230,224, maximizing recovery of refrigerant from a disabled refrigeration unit was accomplished by the series connection of a vacuum pump and a compressor. The present invention is directed to maximizing the percentage of new or recovered refrigerant drawn from a source container to charge or recharge a refrigeration unit.

In the standard method presently used by most air conditioning technicians to charge or recharge an air conditioning unit refrigerant flows under pressure differential from a source container into the suction side of the compressor on the air conditioning unit for a short period of time. The air conditioner is then turned on and permitted to run until the pressure is equalized between the source container and the air conditioning unit. Using this method, after charging or recharging the air conditioning unit, as much as fifteen per cent or more of the refrigerant remains in the source container. Several million pounds of refrigerant are manufactured each year in the United States and up to fifteen per cent of it will be released to the atmosphere using the standard charging method above described. At approximately $2.41 to $9.01 per pound of refrigerant, the direct economic loss is staggering, to say nothing of the unknown problems resulting to the ozone and our atmosphere.

Efficiency in capturing new refrigerants from the container is also poor. Empty cans selected at random from those discarded by contractors after charging air conditioning units with new refrigerant are typically found to still contain an average of in excess of 1½ pounds of refrigerant, or at least five percent of the total contents of a standard can. At least five per cent and perhaps as much as fifteen per cent of all new refrigerants sold in the United States in 1993 will be wasted.

It is, therefore, the primary object of this invention to provide an automatic charge and recharge refrigerant transfer system which transfers or recovers greater quantities of refrigerant from a container than is recovered using presently known charging and recharging methods.

SUMMARY OF THE INVENTION

In accordance with the invention, an automatic charge or recharge refrigerant transfer system is provided which, when used in combination with a recovery system and preferably with the recovery system of our U.S. Pat. No. 5,230,224, increases the percentage of refrigerant transferred from a container to the air conditioning unit to be charged.

The suction line of the compressor of the air conditioning unit is connected to the discharge of the transfer unit and the discharge of the recovery system is connected to the intake of the transfer unit. The intake of the recovery system is connected to the refrigerant source.

The transfer system has an automatic flow path, a manual flow path and a return flow path. The automatic flow path automatically controls the flow of refrigerant from the source through the recovery system to the air conditioning unit at a predetermined maximum pressure level. The parallel manual flow path permits use of a hand valve to control the flow of refrigerant from the source through the recovery system to the air conditioning unit. Finally, the return flow path from the transfer system to a recovery container allows release of refrigerant from the air conditioning unit if the unit is overcharged.

The combination of the present transfer system with the series connected vacuum pump-compressor recovery system of the U.S. Pat. No. 5,230,224 provides greatly increased efficiency in evacuation of the contents of the refrigerant container into the refrigeration unit. It should be noted that, because of the high operating pressure of the recovery unit of this patent, it cannot be used in direct connection to the air conditioning unit to be charged or recharged.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
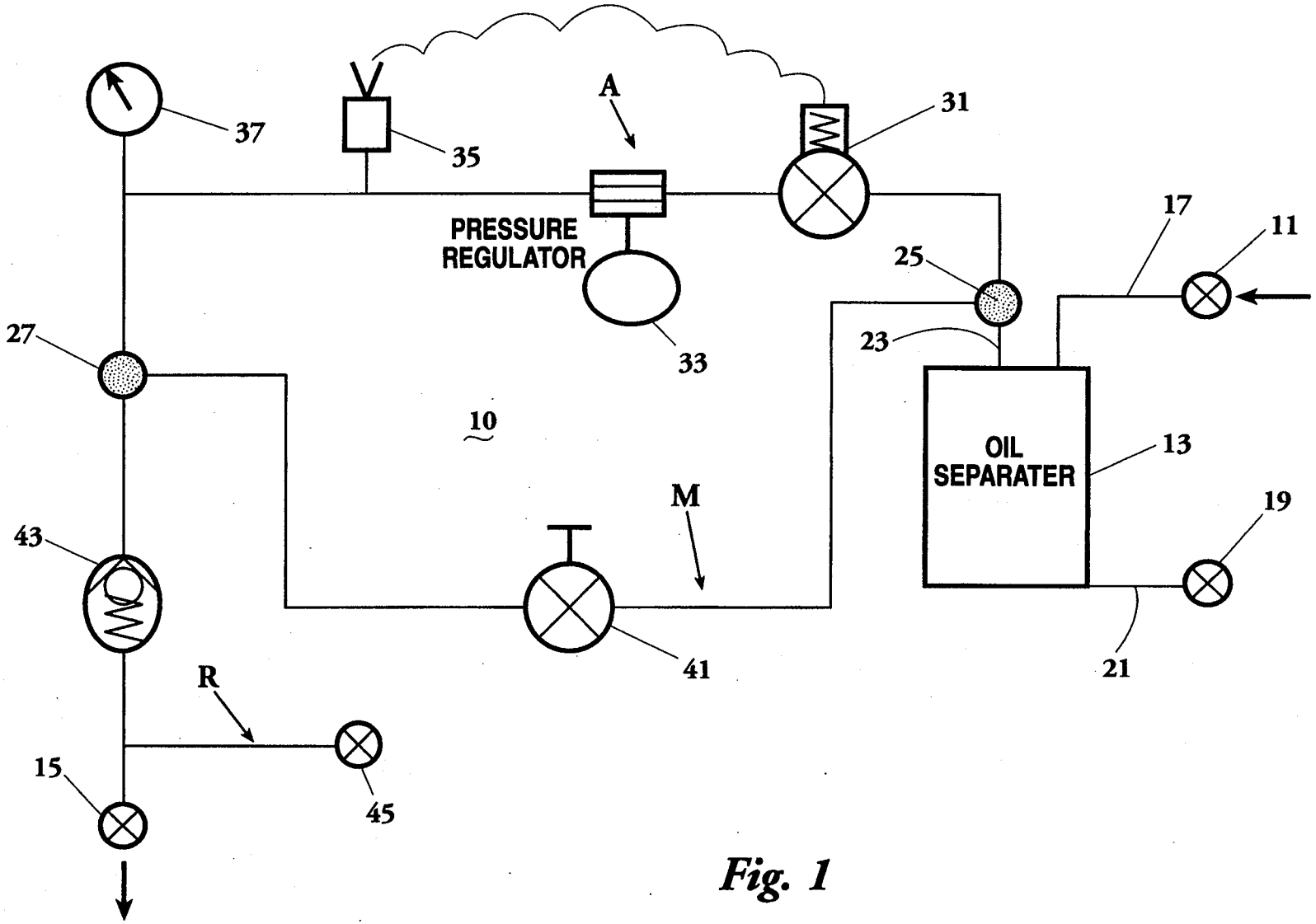
FIG. 1 is a refrigerant flow diagram for an automatic refrigerant transfer system.

Turning first to FIG. 1, the automatic refrigerant transfer system 10 includes an intake valve 11, an oil separator 13 and a discharge valve 15. The refrigerant, in either a liquid or gaseous state, flows from the inlet valve 11 through an inlet line 17 into the separator 13. If the refrigerant is in the liquid state, it expands in the separator 13 into its gaseous state. The separated oil is removed from the separator 13 via an oil drain valve 19 connected in the oil drain line 21 of the separator 13. The gaseous refrigerant in thee oil separator 13 flows through a separator discharge line 23 to a T joint 25 which directs flow into an automatic flow path A and into a manual flow path M.

The automatic flow path A includes the series connection of a solenoid valve 31, a pressure regulator 33, a pressure switch 35 and a low side gauge 37. When the system 10 is turned on, the solenoid valve 31 opens and refrigerant flows through the solenoid valve 31 at a preselected pressure determined by the regulator 33. The pressure switch 35 is set at a level higher than the preselected pressure of the regulator 33 so as to automatically shut the solenoid valve 31 if the regulator 33 should fail or the pressure of the gauge exceed the preselected pressure. The pressure gauge 37 permits constant monitoring of the pressure level through the flow path A.

The manual flow path M includes a hand valve 41. The inlet side of the hand valve 41 is connected to the T joint 25 in the separator discharge line 23. The outlet side of the hand valve 41 is connected to another T joint 27 at the discharge end of the automatic flow path A. Thus, when the hand valve 41 is cracked open, refrigerant in the gaseous state is permitted to flow through the manual flow path M to the second T joint 27. The outlet of the T joint 27 is connected through a check valve 43 to the discharge valve 15. Thus, refrigerant gas flowing through either the automatic flow path A or the manual flow path M continues through the check valve 43 to the discharge valve 15.

A relief flow path R permits back flow of refrigerant from the discharge valve 15 in the event that the air conditioner 70 charged by the system 10 is overcharged. That is, when a return valve 45 connected between the check valve 43 and the discharge valve 15 is opened, the gaseous refrigerant flows from the air conditioning unit 70 back to the check valve 43 where it stops while flow continues through the return valve 45 until the pressure at the suction side of the air conditioning unit 70 is brought to its desired level. The return valve 45 may then be closed and the system 10 stabilized.

Figure 2:
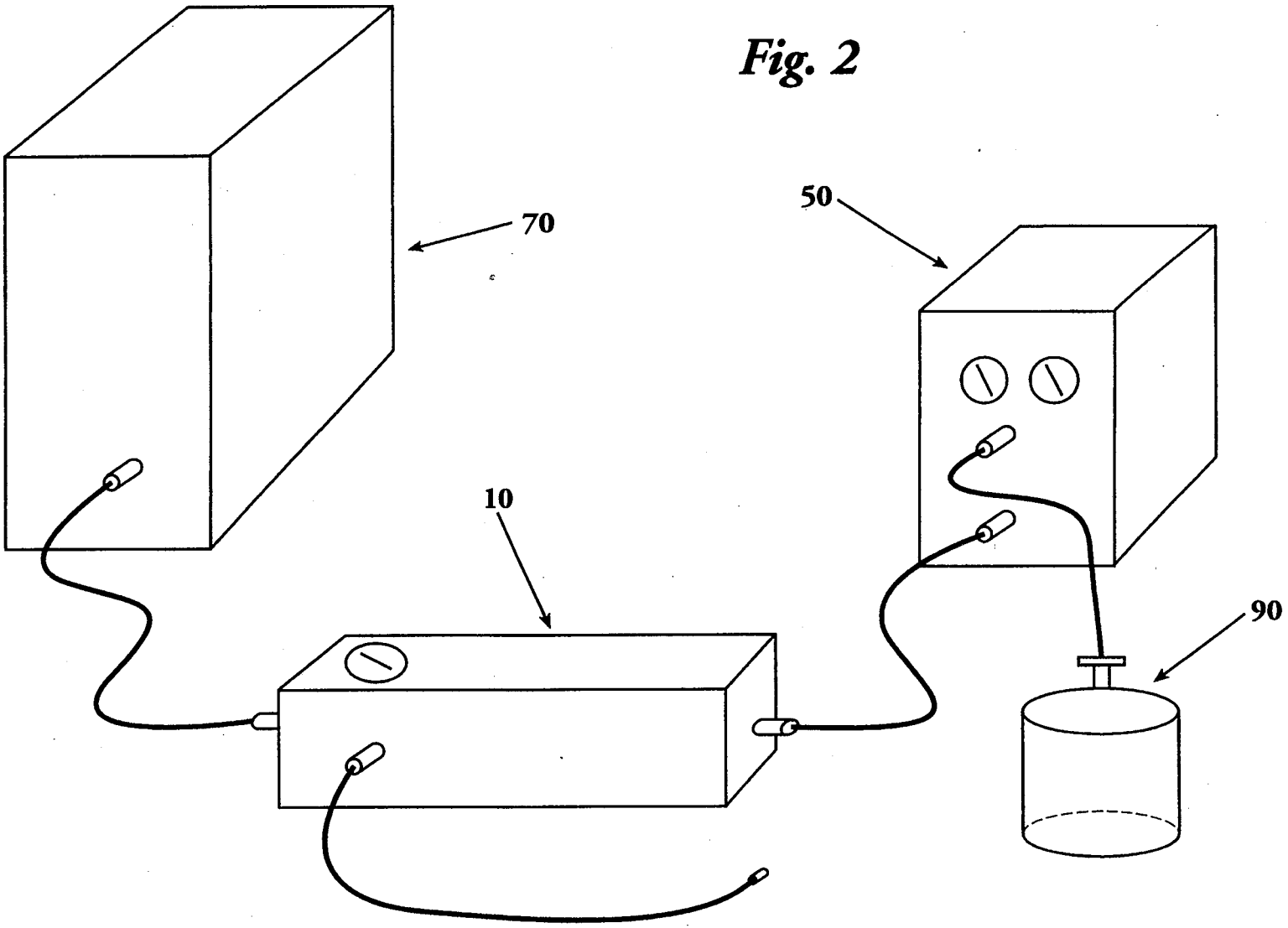
FIG. 2 is a block diagram illustrating the connection of the transfer system of FIG. 1 in combination with a refrigerant source, a recovery system and an air conditioning unit to be charged.

Turning now to FIG. 2, the connection and use of the transfer system 10 with a recovery system 50 such as that described in my U.S. Pat. No. 5,230,224 is illustrated. When the repair on an air conditioning unit is complete and the repaired system has been evacuated to a deep vacuum level (29.9 IN.HG.) for a period of time, the unit is ready to charge with refrigerant gas. A refrigerant can 90 is connected to the recovery system 50 and the recovery system 50 connected to the transfer system 10. The transfer system 10 is also connected to the repaired air conditioning unit to be charged. Both the recovery system 50 and the transfer system 10 are connected to a 115 V power supply. All valves beginning from the refrigerant can 90 through the air conditioning unit 70 are opened. The power switches on the transfer system 10 and the recovery system 50 are turned on to allow the pressure to build to about 40 PSIG. The air conditioning unit 70 is turned on and allowed to charge. If the pressure gauge 37 indicates a value that is too low, more gas is allowed to flow using the hand by-pass valve 41 until the pressure level has stabilized at the proper amount. If the pressure gauge 37 indicates a pressure level that is too high, then the transfer system 10 is connected to a recovery container (with low pressure). The return valve 45 is cracked and refrigerant gas allowed to flow from the air conditioning unit back through the return valves to the recovery container. This will allow the pressure to reduce to the desired level.

If the vacuum level on the recovery system reaches 29.9 inches of mercury for a period of about five minutes and the suction pressure on the air conditioning unit has not reached the desired level, the refrigerant can 90 is empty. Turn off all systems and connect a new can 90 to the recovery system 50. Turn on the systems as before described and continue until the desired suction pressure is reached on the air conditioning unit 70.

Thus, it is apparent that there has been provided, in accordance with the invention, an automatic refrigerant transfer system that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A refrigerant transfer system comprising:

a container storing refrigerant in the gaseous state;

a check valve;

a discharge valve connected in series with said check valve;

a first flow path means connected between said container and said check valve for passing refrigerant in a gaseous state from said container to said discharge valve at not more than a predetermined pressure level; and a second flow path means connected between said container and said check valve for passing refrigerant in a gaseous state from said container to said discharge valve at a pressure level greater than said predetermined pressure level.

2. A system according to claim 1 further comprising a third flow path means connected between said check valve and said discharge valve for passing refrigerant from said discharge valve to a reservoir when an air conditioning unit connected to said discharge valve is overfilled.

3. A refrigerant transfer system comprising:

an intake valve;

an oil separator having an inlet connected to said intake valve and an outlet;

a check valve;

a discharge valve connected in series with said check valve;

a first flow path connected between said outlet and said check valve having a solenoid valve for opening and closing said first flow path, a pressure regulator set at a first pressure level and a pressure switch set a second pressure level higher than said first pressure level for operating said solenoid to close said first flow path when said switch senses said second pressure level;

a second flow path connected between said outlet and said check valve having a manual valve for opening and closing said second flow path.

4. A system according to claim 3 further comprising a third flow path connected at one end thereof between said discharge valve and said check valve and at another end thereof to a return valve.

5. A system for transferring refrigerant from a storage container to an air conditioning unit comprising:

a refrigerant recovery means having an intake connected to the storage container for drawing refrigerant from the storage container;

means connected to said recovery means for receiving refrigerant therefrom in the gaseous and liquid states and for permitting said liquid state refrigerant to expand to a gaseous state;

a check valve;

a discharge valve connected in series between said check valve and the air conditioning unit;

a first flow path means connected between said receiving and permitting means and said check valve for passing refrigerant from said receiving and permitting means to the air conditioning unit at not more than a predetermined pressure level lower than a pressure level of said recovery means; and a second flow path means connected between said receiving and permitting means and said check valve for passing refrigerant from said receiving and permitting means to the air conditioning unit at a pressure level greater than said predetermined pressure level and lower than said recovery means pressure level.

6. A system according to claim 5 further comprising a third flow path means connected between said check valve and said discharge valve for passing refrigerant from the air conditioning unit to a reservoir when the air conditioning unit is overfilled.

7. A system according to claim 6, said recovery means having a vacuum pump and a compressor connected in series.

8. A system for transferring refrigerant from a storage container to an air conditioning unit comprising:

a refrigerant recovery means having an intake connected to the storage container for drawing refrigerant at a discharge pressure from the storage container;

means connected to said recovery means for receiving refrigerant therefrom in the gaseous and liquid states and for permitting said liquid state refrigerant to expand to a gaseous state;

a check valve;

a discharge valve connected in series between said check valve and the air conditioning unit;

a first flow path connected between said receiving and permitting means and said check valve having a solenoid valve for opening and closing said first flow path, a pressure regulator set at a low pressure level relative to said recovery means discharge pressure level and a pressure switch set at an intermediate pressure level higher than said low pressure level and lower than said recovery means discharge pressure level for operating said solenoid to close said first flow path when said switch senses said intermediate pressure level;

a second flow path connected between said receiving and permitting means and said check valve having a manual valve for opening and closing said second flow path.

9. A system according to claim 8 further comprising a third flow path connected at one end thereof between said discharge valve and said check valve and at another end thereof to a return valve.

10. A system according to claim 9, said recovery means having a vacuum pump and a compressor connected in series.

* * * * *